US010722906B2

(12) United States Patent
Huang et al.

(10) Patent No.: US 10,722,906 B2
(45) Date of Patent: Jul. 28, 2020

(54) PUSH-BUTTON SWITCHING SHOWER HEAD STRUCTURE

(71) Applicant: Purity (Xiamen) Sanitary Ware Co., Ltd., Xiamen, Fujian (CN)

(72) Inventors: Jiayuan Huang, Xiamen (CN); Xingchuan Ling, Xiamen (CN); Guozhong Wu, Xiamen (CN); Xiwen Yang, Xiamen (CN)

(73) Assignee: PURITY (XIAMEN) SANITARY WARE CO., LTD., Xiamen, Fujian (CN)

( * ) Notice: Subject to any disclaimer, the term of this patent is extended or adjusted under 35 U.S.C. 154(b) by 128 days.

(21) Appl. No.: 16/136,248

(22) Filed: Sep. 19, 2018

(65) Prior Publication Data

US 2020/0086332 A1 Mar. 19, 2020

(51) Int. Cl.
*B05B 1/16* (2006.01)

(52) U.S. Cl.
CPC ..... *B05B 1/1627* (2013.01)

(58) Field of Classification Search
CPC ..... B05B 1/1609; B05B 1/1636; B05B 1/185; B05B 1/30; B05B 1/3026; B05B 1/16; B05B 1/1627; B05B 1/1663
USPC ..... 239/436–499
See application file for complete search history.

(56) References Cited

U.S. PATENT DOCUMENTS 4,143,821 A * 3/1979 Aghnides ..... B05B 1/083 239/381
4,921,002 A * 5/1990 Christon ..... A01G 25/162 137/119.03
5,433,384 A * 7/1995 Chan ..... B05B 1/1636 239/239
5,727,591 A * 3/1998 Doll ..... F16K 31/105 137/554
5,819,789 A * 10/1998 Schneider ..... F16K 3/08 137/454.5
5,871,296 A * 2/1999 Furukawa ..... B43K 5/1881 401/106
6,233,758 B1 * 5/2001 Jeong ..... B05B 1/302 4/615
6,367,710 B2 * 4/2002 Fan ..... B05B 1/1636 239/381
6,612,507 B1 * 9/2003 Meyer ..... A46B 11/06 239/394
6,738,996 B1 * 5/2004 Malek ..... B05B 1/1618 239/441
6,755,204 B2 * 6/2004 Herbert ..... F16K 11/166 137/1
7,070,125 B2 * 7/2006 Williams ..... B05B 1/1618 239/443

(Continued)

*Primary Examiner* — Viet Le
(74) *Attorney, Agent, or Firm* — Leong C. Lei

(57) ABSTRACT

A push-button switching shower head structure includes a shower head body, a water inlet seat, a button, a push rod, a push block, a return spring, a ratchet wheel, a water distribution disc, and an outlet disc. The button pushes the push rod to move, and the push rod drives the push block to move and drive the ratchet wheel to rotate, and then the ratchet wheel drives the water distribution disc to rotate synchronously to cooperate with the outlet disc to perform waterway switching. The shower head has the advantages of long service life and stable and reliable switching function by providing a guiding groove on the water inlet seat.

9 Claims, 9 Drawing Sheets

(56) References Cited

U.S. PATENT DOCUMENTS 7,818,828 B2 * 10/2010 Zhou ..... B05B 1/1663 137/883
7,988,070 B1 * 8/2011 Yang ..... B05B 1/18 239/116
8,066,203 B2 * 11/2011 Zhou ..... B05B 1/1636 239/443
8,113,442 B2 * 2/2012 Li ..... B05B 1/18 239/11
9,022,057 B2 * 5/2015 Zink ..... B05B 1/3006 137/240
9,199,252 B2 * 12/2015 Schorn ..... B05B 1/1681
9,394,259 B2 * 7/2016 Zhou ..... B05B 1/1636
9,427,749 B2 * 8/2016 Zhou ..... B05B 1/1636
9,470,334 B2 * 10/2016 Zhou ..... F16K 31/44
9,545,639 B2 * 1/2017 Meehan ..... B05B 1/1627
9,616,434 B2 * 4/2017 Pan ..... B05B 1/1636
9,714,502 B2 * 7/2017 Huang ..... E03C 1/0405
9,776,196 B2 * 10/2017 Yu ..... A47K 3/28
9,795,974 B2 * 10/2017 Zhou ..... B05B 1/18
9,829,116 B2 * 11/2017 Xu ..... F16K 31/535
9,895,702 B2 * 2/2018 Lei ..... B05B 1/12
9,901,939 B2 * 2/2018 Lin ..... B05B 1/1636
10,058,878 B2 * 8/2018 Hu ..... B05B 1/1636
10,179,337 B2 * 1/2019 Lin ..... B05B 1/1636
2005/0258274 A1 * 11/2005 Wang ..... B05B 1/1636 239/393
2006/0219822 A1 * 10/2006 Miller ..... B05B 1/304 239/562
2009/0288250 A1 * 11/2009 Zhou ..... B05B 1/1636 4/615
2010/0148104 A1 * 6/2010 Ho-Yeong ..... E03C 1/055 251/209
2010/0264237 A1 * 10/2010 Engel ..... B05B 1/1654 239/443
2010/0320295 A1 * 12/2010 Mang ..... B05B 1/18 239/562
2012/0111973 A1 * 5/2012 Cheng ..... E03C 1/0409 239/214
2012/0259282 A1 * 10/2012 Alderete, Jr. ..... A61M 5/14244 604/131
2012/0267453 A1 * 10/2012 DeVaney ..... A62C 31/28 239/288.5
2012/0305116 A1 * 12/2012 Zhou ..... B05B 1/1636 137/625.46
2013/0015269 A1 * 1/2013 Zhou ..... B05B 1/1636 239/437
2013/0247294 A1 * 9/2013 Zhou ..... B05B 1/1636 4/615
2013/0284823 A1 * 10/2013 Zhou ..... B05B 1/18 239/438
2014/0027234 A1 * 1/2014 Zhou ..... B05B 1/1636 192/43.1
2014/0182691 A1 * 7/2014 James ..... F16K 11/078 137/3
2014/0339332 A1 * 11/2014 Bartelick ..... F24C 14/005 239/195
2015/0224519 A1 * 8/2015 Buhler ..... B05B 1/18 239/443
2016/0167062 A1 * 6/2016 Pan ..... B05B 1/1636 239/442
2016/0221006 A1 * 8/2016 Lin ..... B05B 1/1636
2016/0310972 A1 * 10/2016 Lin ..... B05B 1/18
2016/0325291 A1 * 11/2016 Zhou ..... B05B 1/18
2017/0056897 A1 * 3/2017 Xu ..... F16K 31/535
2017/0100727 A1 * 4/2017 Lin ..... B05B 1/1636
2017/0100728 A1 * 4/2017 Gong ..... B05B 1/1681
2017/0136473 A1 * 5/2017 Yu ..... B05B 1/1636
2018/0029049 A1 * 2/2018 Hu ..... B05B 1/18
2018/0051816 A1 * 2/2018 Lin ..... F16K 31/52483

* cited by examiner

PUSH-BUTTON SWITCHING SHOWER HEAD STRUCTURE

BACKGROUND OF THE INVENTION

1. Field of the Invention

The present invention relates to a bathroom accessory, and more particularly to a push-button switching shower head structure.

2. Description of the Prior Art

In general, a conventional hand-held shower head switches spray modes by rotating an outlet panel. The user needs to apply a force with both hands, which is relatively laborious to operate and cannot be operated with one hand.

In order to facilitate the switching of the spray modes of the shower head with one hand, a shower head with a single button to switch spray modes has been developed on the market. As shown in FIG. 12, specifically, in the single button switching shower head, a button 1' is used to drive a push rod 2' to move. The push rod 2' is provided with a push block 3' and a first spring 4'. The push block 3' drives a ratchet wheel 5' in the shower head to rotate in one direction. The ratchet wheel 5' rotates synchronously with a water distribution disc in the shower head. In use, the button 1' is pressed to drive the push rod 2' to move, the push rod 2' further drives the push block 3' to move, and the push block 3' drives the ratchet wheel 5' to rotate, so that the water distribution disc is rotated for the water distribution holes of the water distribution disc to communicate with different inlet holes of an outlet disc so as to switch spray modes. After the end of the pressing, the push rod 2' is reversely moved and returned by the action of the first spring 4', so that the push block 3' is driven to move in the reverse direction and returned. However, since there is no limit mechanism, the button 1' drives the push block 3' to move for the push block 3' to disengage from the ratchet wheel 5', and the ratchet wheel 5' drives the water distribution disc to complete the switching of the spray modes. In this way, the pressing feel is not good.

In order to ensure that the push block 3' can mesh with the ratchet wheel 5' after the push block 3' is returned and the push block 3' can drive the ratchet wheel 5' to rotate, the push block 3' is movably fitted on the push rod 2', and a second spring 6' is provided between the push block 3' and the push rod 2'. The second spring 6' holds against the push block 3' so that the push block 3' holds against the ratchet wheel 5'. However, the second spring 6' causes the push block 3' to always hold the ratchet wheel 5'. When the push block 3' is moved to mesh with the teeth of the ratchet wheel 5', the push block 3' and the ratchet wheel 5' will rub against each other. As a result, the push block 3' and the ratchet wheel 5' are worn easily, which easily causes the switching function of the shower head to be invalid. The service life is not long. Besides, the push rod 2' and the second spring 6' cause the ratchet wheel 5' to be subjected to two applied forces of the push block 3' when rotated. The two applied forces are perpendicular to each other. The first applied force is generated by the push block 3' because the push rod 2' pushes the push block 3' to move forward. The second applied force is generated by the push block 3' because the second spring 6' holds against the push block 3'. The resultant force of the two applied forces may be along the radial direction of the ratchet wheel 5', resulting in that the push block 3' cannot push the ratchet wheel 5' to rotate and the ratchet wheel 5' is stuck. At this time, the user needs to change the force applied to the push rod 2' for the push block 3' to push the ratchet wheel 5' to rotate. Therefore, in addition to the problem of short service life, the conventional single button switching shower head has the disadvantage that the switching is not stable enough. Accordingly, the inventor of the present invention has devoted himself based on his many years of practical experiences to solve these problems.

SUMMARY OF THE INVENTION

The primary object of the present invention is to provide a push-button switching shower head structure, which has a long service life and a stable and reliable switching function.

In order to achieve the above object, the present invention adopts the following technical solutions.

A push-button switching shower head structure comprises a shower head body a water inlet seat, a button, a push rod, a push block, a return spring, a ratchet wheel, a water distribution disc, and an outlet disc. The water inlet seat is fixed in the shower head body. The water inlet seat is provided with an upright through hole and an inlet end opening communicating with a water inlet end of the shower head body. A guide groove is defined on a top surface of the water inlet seat. One side of the guide groove, close to the through hole, is provided with a guide surface. The outlet disc is installed to a water outlet end of the shower head body and located under the water inlet seat. The outlet disc is provided with at least two functional water chambers. The ratchet wheel is rotatably fitted on the top surface of the water inlet seat and coaxially disposed with the through hole. The water distribution disc is rotatably fitted between the water inlet seat and the outlet disc. The water distribution disc has a rotating shaft that passes through the through hole and is coaxially connected to the ratchet wheel. The water distribution disc is provided with water distribution holes to communicate with water inlets of the functional water chambers. The push rod is movably fitted on the top surface of the water inlet seat. The push rod is provided with a lateral mounting groove. The return spring is disposed between the push rod and the water inlet seat. The push block is movably inserted into the lateral mounting groove and movably engaged with teeth of the ratchet wheel. The push block is provided with a guide post which is inserted into the guide groove. A side wall of the guide post movably abuts against the guide surface. The button is movably fitted on the shower head body and cooperates with the push rod.

Preferably, the top surface of the water inlet seat is provided with a guide hole, and the push rod is movably inserted into the guide hole.

Preferably, one side of the push rod is provided with a protruding block. The protruding block is formed with a post. The top surface of the water inlet seat is provided with a stopper. The return spring is fitted on the post. Two ends of the return spring hold the protruding block and the stopper, respectively.

Preferably, a bottom of the water distribution disc is provided with a first unidirectional guide rail. A top of the outlet disc is provided with a second unidirectional guide rail to mesh with the first unidirectional guide rail.

Preferably, the water distribution disc is movable up and down and disposed under the water inlet seat. An adjusting spring is disposed between the water distribution disc and the water inlet seat. The first unidirectional guide rail includes a plurality of first oblique teeth disposed on a bottom surface of the water distribution disc and arranged circumferentially. The second unidirectional guide rail includes a plurality of second oblique teeth disposed on a top surface of the outlet disc and arranged circumferentially. The first oblique teeth are unidirectionally meshed with the second oblique teeth.

Preferably, the button is hingedly connected to the water inlet seat. The shower head body is provided with an opening for the button to be exposed. A swing block is hingedly connected to the water inlet seat. One end of the swing block abuts against the button, and another end of the swing block abuts against one end of the push rod.

Preferably, a push block spring is provided between the push block and the lateral mounting groove.

Preferably, the water inlet seat is connected with the outlet disc. A water passing chamber is formed between the water inlet seat and the outlet disc. The inlet end opening of the water inlet seat communicates with the water passing chamber. The water distribution disc is located in the water passing chamber.

Preferably, the guide surface is a curved surface that is coaxially disposed with the through hole.

When in use, the button is pressed to drive the push rod to move. The push rod drives the push block to move, so that the push block pushes the ratchet wheel to rotate. When the ratchet wheel is rotated, the ratchet wheel drives the water distribution disc to rotate synchronously, thereby performing waterway switching. After the end of the pressing, under the action of the return spring, the push rod and the push block are reversely moved together and returned.

The present invention has the following advantages.

1. During the movement of the push block, because the guide post of the push block abuts against the guide surface, the guide surface can guide the push block so that the push block is moved along the guide surface, such that the push block applies only a force along the guide surface to the ratchet wheel. The guide surface enables the push block to engage the teeth of the ratchet wheel and drive the ratchet wheel to rotate, preventing the ratchet wheel from being stuck. The switching function of the present invention is stable. The guide surface can play a limit on the push block to control the relative position of the push block and the ratchet wheel. When the push block is moved to engage the teeth of the ratchet wheel, it is possible to avoid mutual friction between the push block and the ratchet wheel through the guide surface, so that the service life of the shower head of the present invention is long.

2. The bottom of the water distribution disc is provided with the first unidirectional guide rail, and the top of the outlet disc is provided with the second unidirectional guide rail to mesh with the first unidirectional guide rail. Through the cooperation of the first unidirectional guide rail and the second unidirectional guide rail, the water distribution disc can only rotate in one direction, which can prevent the ratchet wheel from rotating in the reverse direction when the push block is returned.

DETAILED DESCRIPTION OF THE PREFERRED EMBODIMENTS

Figure 1:
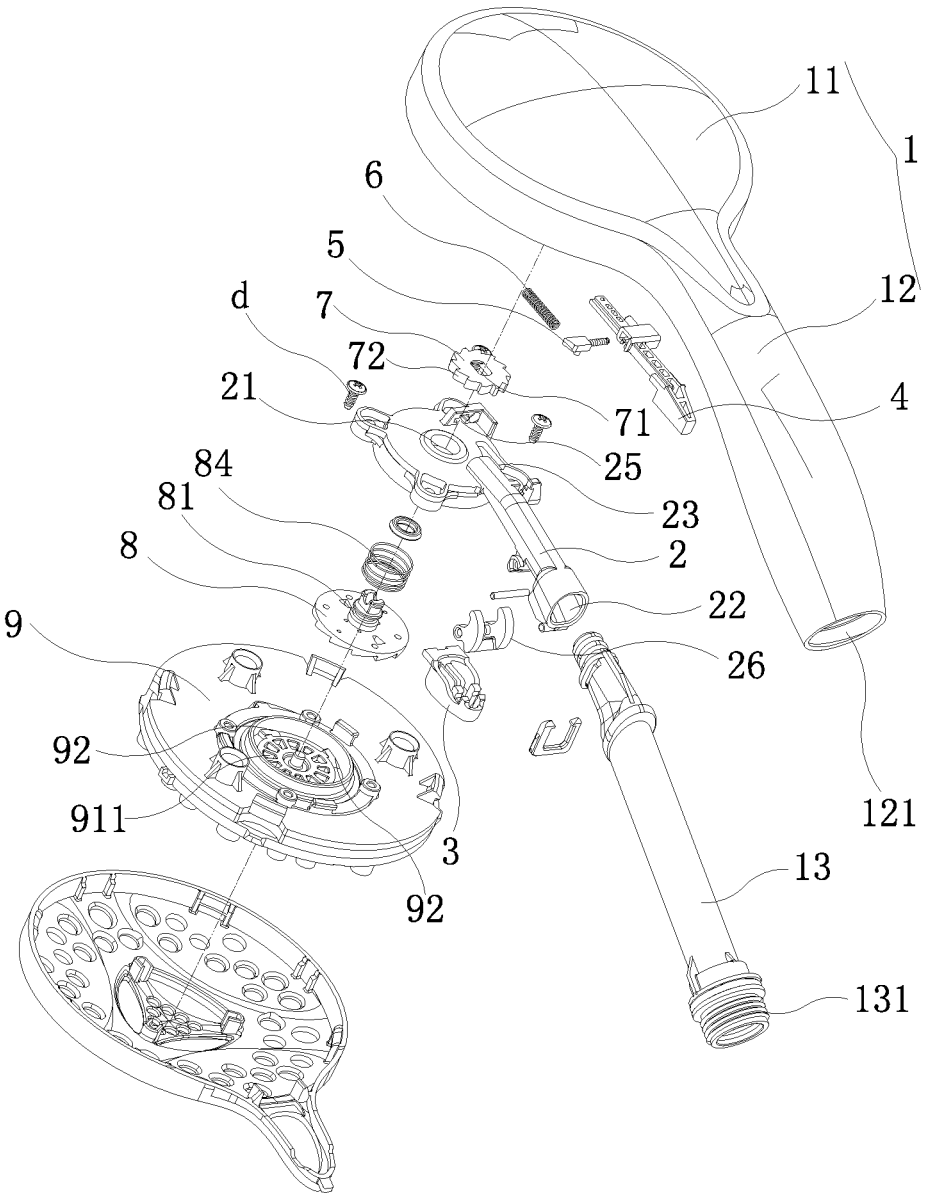
FIG. 1 is an exploded view of the present invention.
Figure 2:
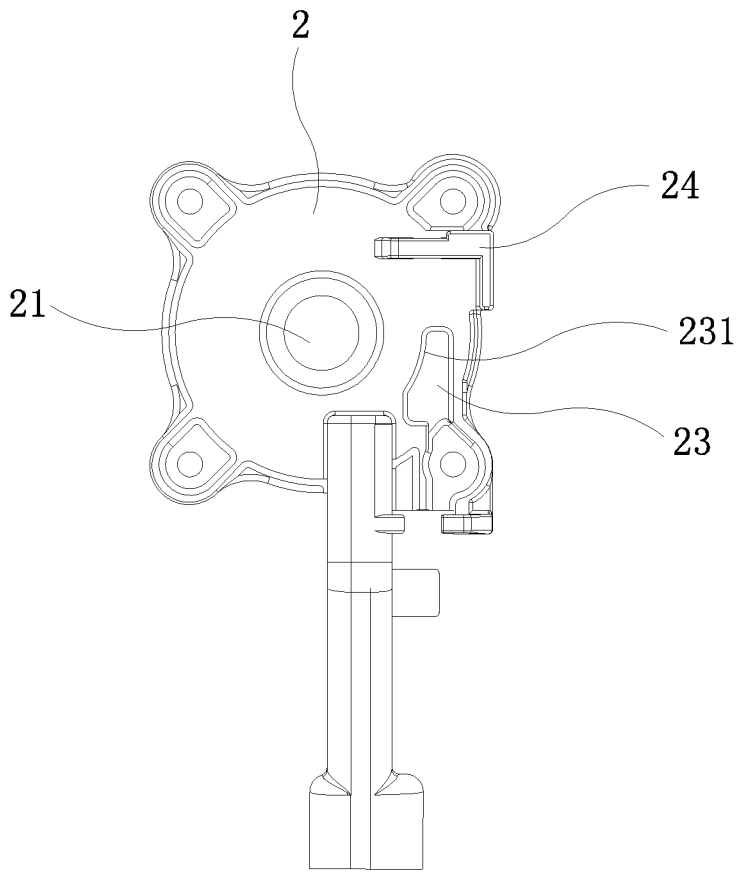
FIG. 2 is a structural schematic view of the water inlet seat of the present invention.
Figure 3:
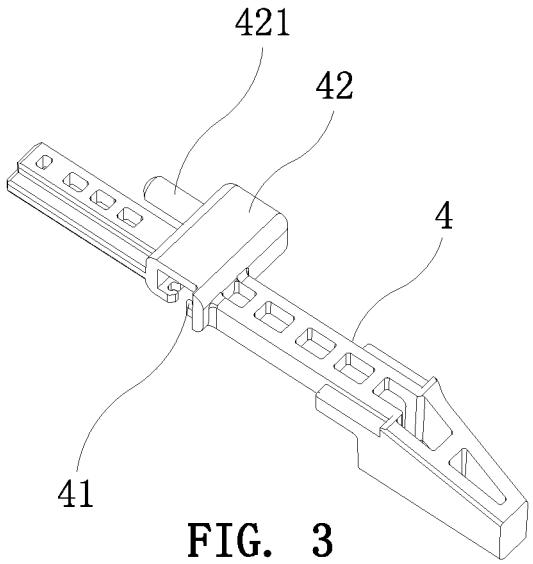
FIG. 3 is a structural schematic view of the push rod of the present invention.
Figure 4:
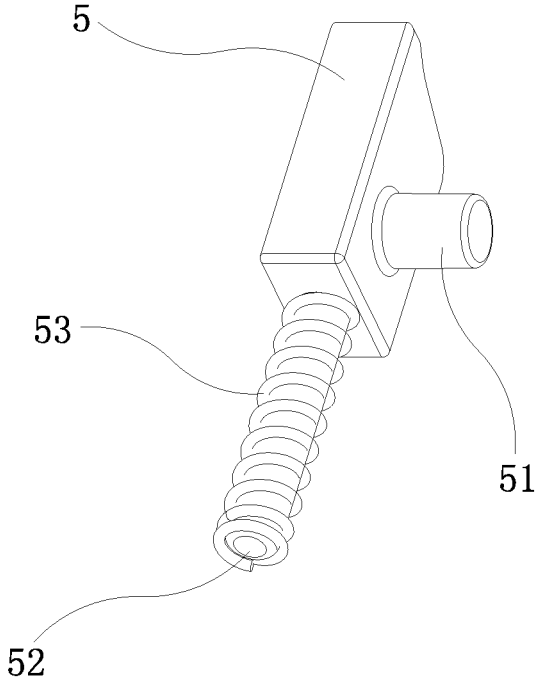
FIG. 4 is a structural schematic view of the push block of the present invention.

Embodiments of the present invention will now be described, by way of example only, with reference to the accompanying drawings.

As shown in FIG. 1 to FIG. 11, the present invention discloses a push-button switching shower head structure, comprising a shower head body 1, a water inlet seat 2, a button 3, a push rod 4, a push block 5, a return spring 6, a ratchet wheel 7, a water distribution disc 8, and an outlet disc 9.

Specifically, the shower head body 1 includes a head portion 11 and a handle 12 connected to each other. The head portion 11 has an accommodating chamber 111 with a bottom opening. The bottom opening of the accommodating chamber 111 is the water outlet end of the shower head body 1. The handle 12 is a hollow structure and has a connecting hole 121 therein. The connecting hole 121 communicates with the accommodating chamber 111. A water inlet tube 13 is disposed in the connecting hole 121. An end of the water inlet tube 13, away from the accommodating chamber, is the water inlet end of the shower head body 1. The water inlet end is formed with a threaded portion 131 for connecting a shower head hose.

The outlet disc 9 is provided with at least two functional water chambers 91. Respective water inlets 911 of the functional water chambers 91 are disposed on the top surface of the outlet disc 9. The water inlets 911 of the functional water chambers 91 may be circumferentially arranged on the top surface of the outlet disc 9. The outlet disc 9 may be connected to the bottom opening of the accommodating chamber 111 of the shower head body 1 by means of a snap-fit connection, or may be connected to the bottom opening of the accommodating chamber 111 of the shower head body 1 by screwing.

The water inlet seat 2 is fixed in the accommodating chamber 111 of the shower head body 1 and located above the outlet disc 9. The water inlet seat 2 is provided with an upright through hole 21 and an inlet end opening 22 communicating with the water inlet end of the shower head body 1. A guide groove 23 is defined on the top surface of the water inlet seat 2. One side of the guide groove 23, close to the through hole 21, is provided with a guide surface 231. The guide surface 231 may be a curved surface that is coaxially disposed with the through hole 21. The water inlet tube 13 is insertedly mated with the inlet end opening 22 of the water inlet seat 2, such that the inlet end opening 22 communicates with the water inlet end of the shower head body 1. The water inlet seat 2 is connected to the outlet disc 9 through a screw d so as to fix the water inlet seat 2 in the shower head body 1. A water passing chamber communicating with the inlet end opening 22 is formed between the water inlet seat 2 and the outlet disc 9. The water inlet seat 2 may be connected to the outlet disc 9 by means of a snap-fit connection or by screwing so that the water inlet seat 2 is fixed in the shower head body 1, but not limited thereto. The water inlet seat 2 may be directly connected to the inner wall of the accommodating chamber 111 of the shower head body 1 to be fixed in the shower head body 1.

The ratchet wheel 7 is rotatably fitted on the top surface of the water inlet seat 2 and coaxially disposed with the through hole 21. The water distribution disc 8 is rotatably fitted between the water inlet seat 2 and the outlet disc 9. The water distribution disc 8 has a rotating shaft 81 that passes through the through hole 21 and is coaxially connected to the ratchet wheel 7. The water distribution disc 8 is provided with water distribution holes 82 to communicate with the water inlets 911 of the functional water chambers 91 respectively. The number of the water distribution holes 82 is two and may be symmetrically arranged.

The push rod 4 is movably fitted on the top surface of the water inlet seat 2. The push rod 4 is provided with a lateral mounting groove 41. The return spring 6 is disposed between the push rod 4 and the water inlet seat 2 for driving the push rod 4 to return. The push block 5 is movably inserted into the lateral mounting groove 41 and movably engaged with teeth 72 of the ratchet wheel 7. The push block 5 is provided with a guide post 51 which is inserted into the guide groove 23. The side wall of the guide post 51 movably abuts against the guide surface 231, such that the push block 5 can be moved along the guide surface 231 by the action of the guide surface 231. The top surface of the water inlet seat 2 is provided with a stopper 24. One side of the push rod 4 is provided with a protruding block 42. The protruding block 42 is formed with a post 421. The return spring 6 is fitted on the post 421. Two ends of the return spring 6 hold the protruding block 42 and the stopper 24, respectively. The top surface of the water inlet seat 2 is provided with a guide hole 25. The push rod 4 is movably inserted into the guide hole 25. The movement of the push rod 4 is guided through the guide hole 25, so that the push rod 4 is oriented and moved. A push block spring 53 is disposed between the push block 5 and the lateral mounting groove 41. The push block spring 53 provides an elastic force to the push block 5, ensuring that the guide post 51 of the push block 5 can stably abut against the guide surface 231.

The button 3 is movably fitted on the shower head body 1 and cooperates with the push rod 4. The push rod 4 is driven to move by pressing the button 3. Specifically, the button 3 is hingedly connected to the water inlet seat 2. The shower head body 1 is provided with an opening 14 for the button 3 to be exposed so that the user can press the button 3. A swing block 26 is hingedly connected to the water inlet seat 2. One end of the swing block 26 abuts against the button 3, and another end of the swing block 26 abuts against one end of the push rod 4. In this way, the button 3 can drive the push rod 4 to move through the swing block 26.

In order to understand the present invention, the working principles of the present invention are set forth below:

As shown in FIG. 8 to FIG. 11, when in use, the user presses the button 3. The button 3 pushes the swing block 26 to rotate in the forward direction, and the swing block 26 in turn pushes the push rod 4 to move in the forward direction to compress the return spring 6. The push rod 4 simultaneously drives the push block 5 to move in the forward direction, so that the push block 5 pushes the ratchet wheel 7 to rotate in the forward direction. While the ratchet wheel 7 is rotated in the forward direction, the ratchet wheel 7 drives the water distribution disc 8 to rotate synchronously, thereby performing waterway switching. When the guide post 51 of the push block 5 is engaged with the guide groove 23, the waterway switching is in place. After the end of the pressing, under the action of the restoring force of the return spring 6, the push rod 4 and the push block 5 are reversely moved together. When the push rod 4 is returned, the swing block 26 is pushed to reversely rotate and return. The reverse rotation of the swing block 26 pushes the button 3 to reversely move and return. During the movement of the push block 5, since the side wall of the guide post 51 of the push block 5 abuts against the guide surface 231, the guide surface 231 guides the push block 5 to move so that the push block 5 is moved along the guide surface 231 and the push block 5 applies a force along the guide surface 231 to the ratchet wheel 7. Because the guide surface 231 is a curved surface that is coaxially disposed with the through hole 21, the push block 5 applies a force to the ratchet wheel 7 tangentially along the ratchet wheel 7. The guide surface 231 enables the push block 5 to engage the teeth 72 of the ratchet wheel 7 and drive the ratchet wheel 7 to rotate. This can prevent the force applied to the ratchet wheel 7 by the push block 5 from being radial along the ratchet wheel 7, thereby preventing the ratchet wheel 7 from being stuck and making the switching function of the present invention stable. The guide surface 231 can play a limit on the push block 5 to control the relative position of the push block 5 and the ratchet wheel 7. When the push block 5 is moved to engage the teeth 72 of the ratchet wheel 7, it is possible to avoid mutual friction between the push block 5 and the ratchet wheel 7 through the guide surface 231, so that the service life of the shower head of the present invention is long.

Figure 5:
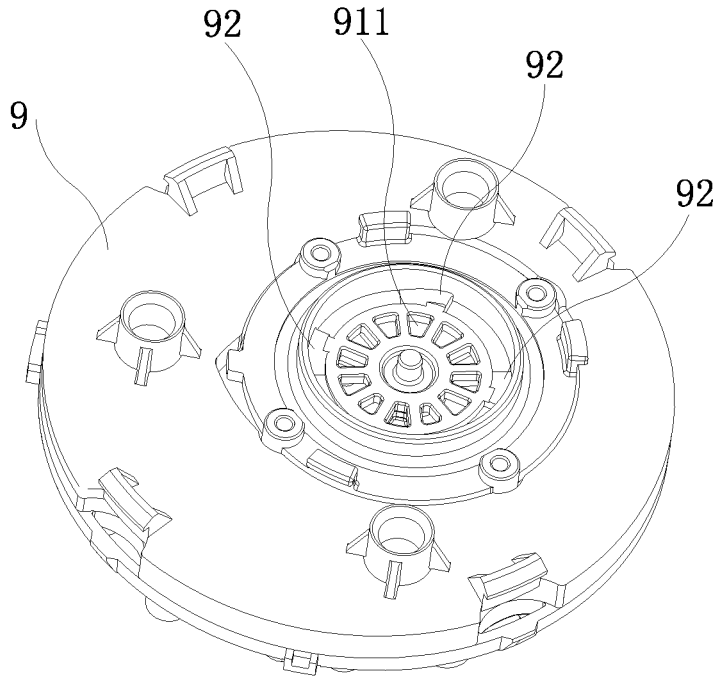
FIG. 5 is a structural schematic view of the outlet disc of the present invention.
Figure 6:
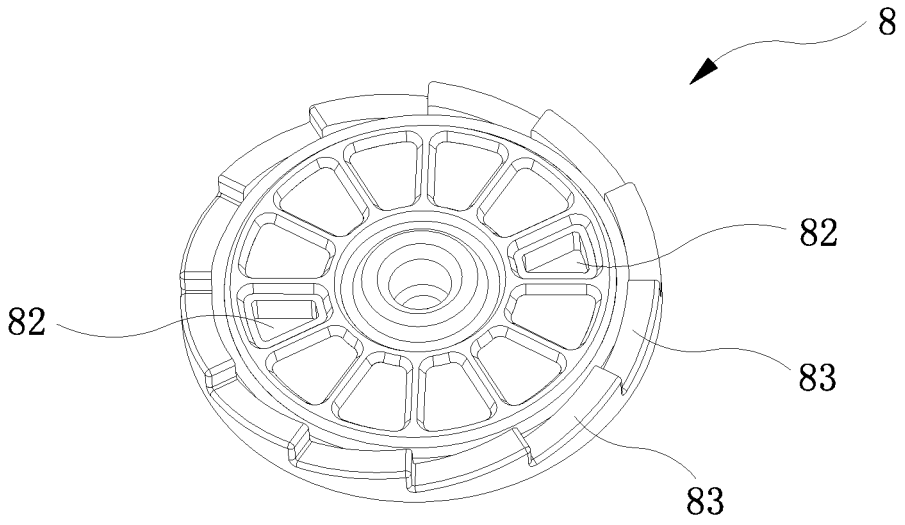
FIG. 6 is a first structural schematic view of the water distribution disc of the present invention.
Figure 7:
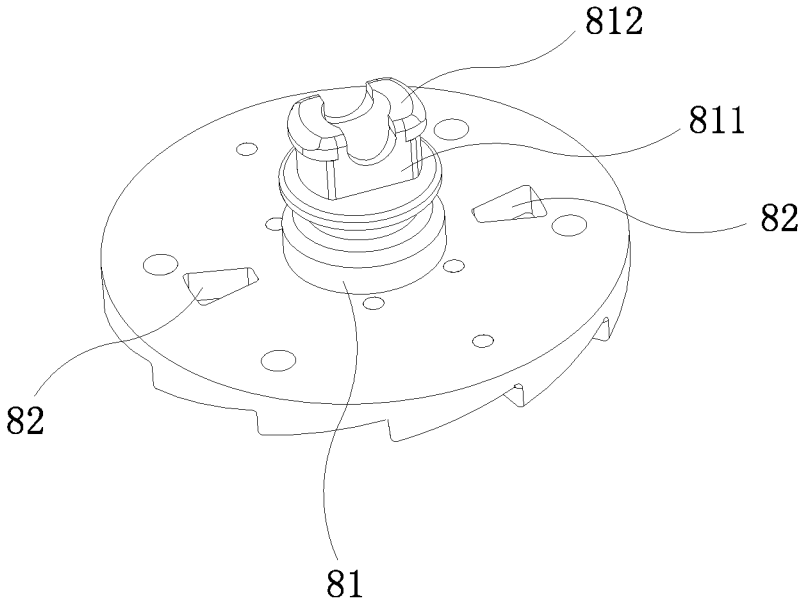
FIG. 7 is a second structural schematic view of the water distribution disc of the present invention.
Figure 8:
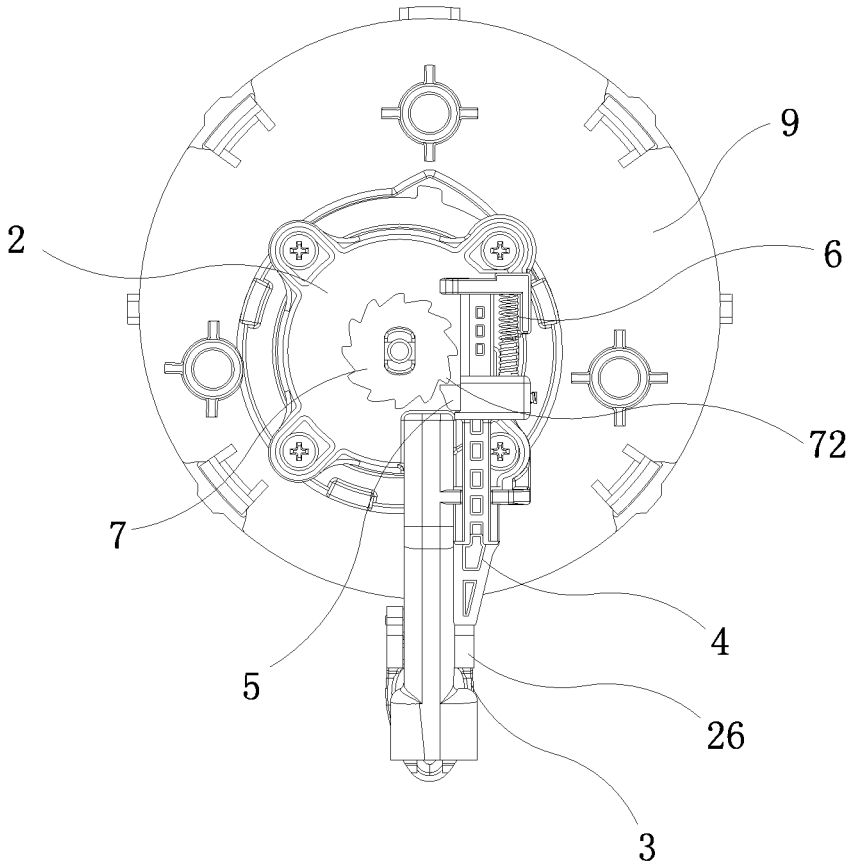
FIG. 8 is a schematic view of the button in an initial state of the present invention.
Figure 9:
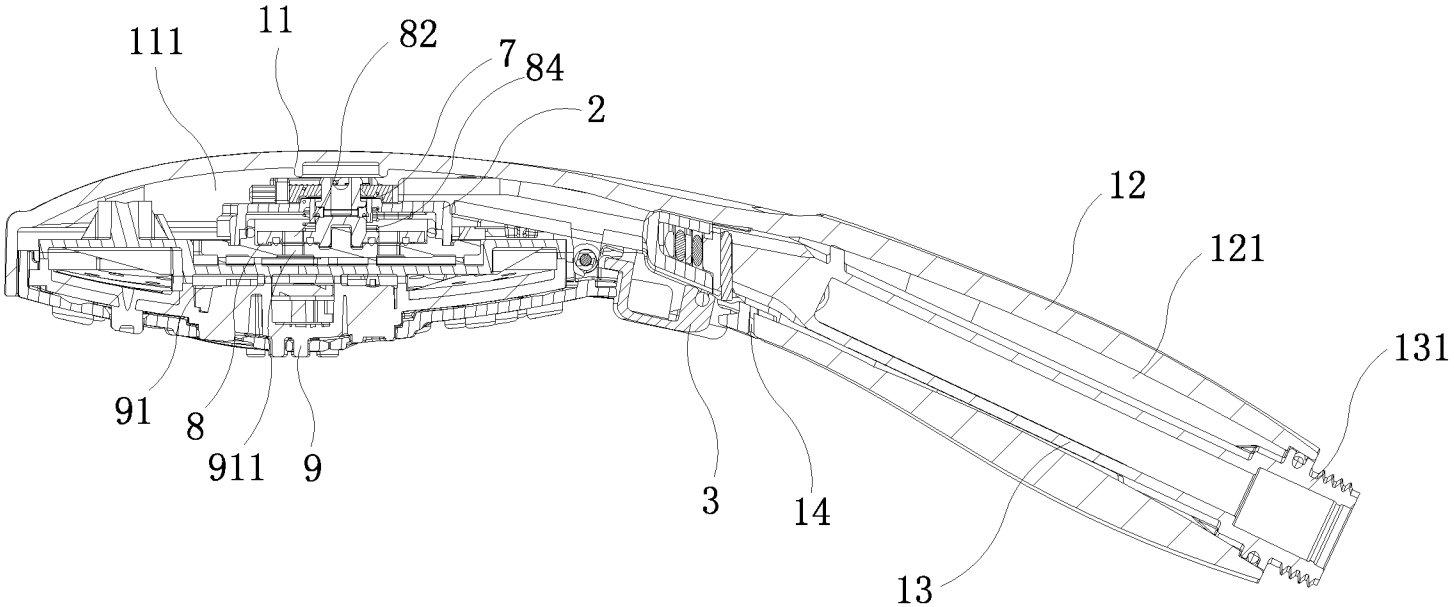
FIG. 9 is a sectional view of the button in an initial state of the present invention.
Figure 10:
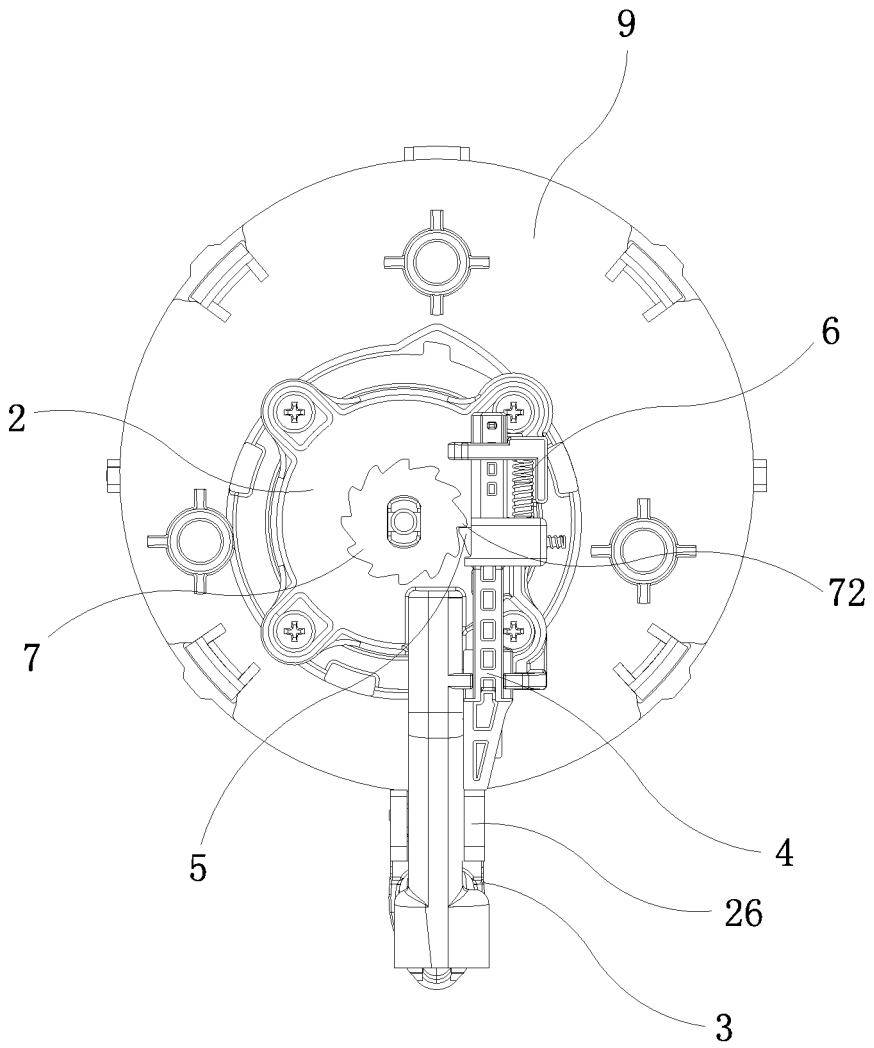
FIG. 10 is a schematic view of the button in a pressed state of the present invention.
Figure 11:
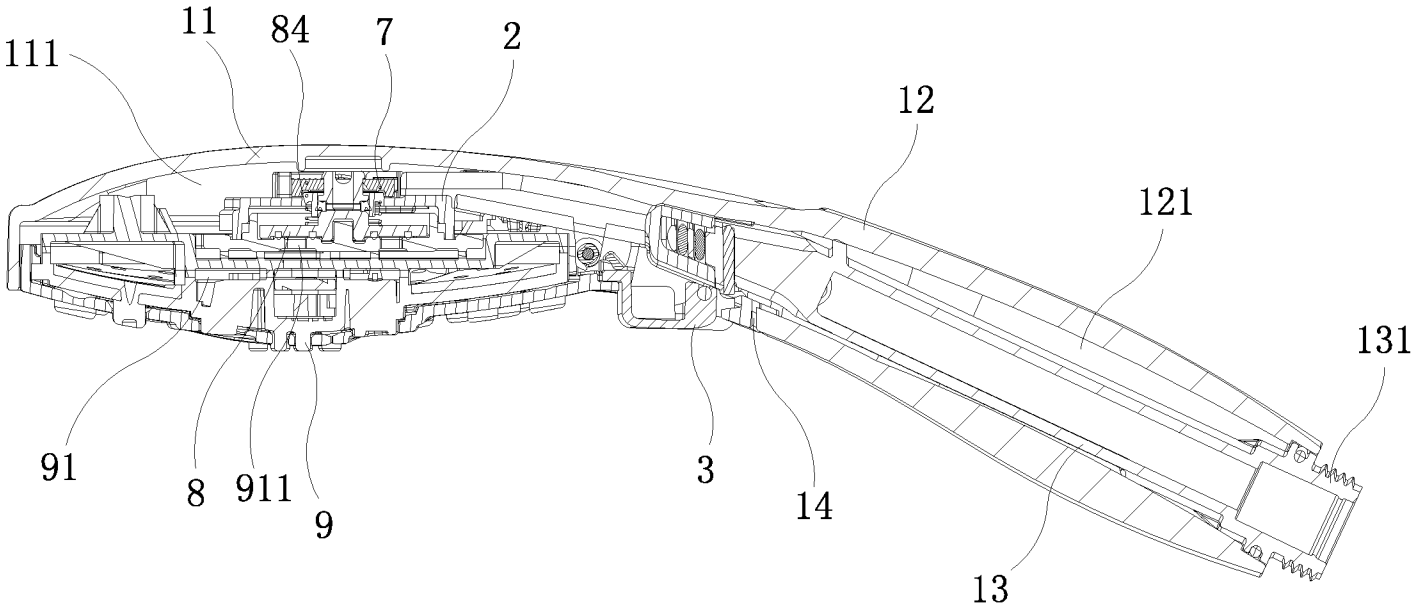
FIG. 11 is a sectional view of the button in a pressed state of the present invention.
Figure 12:
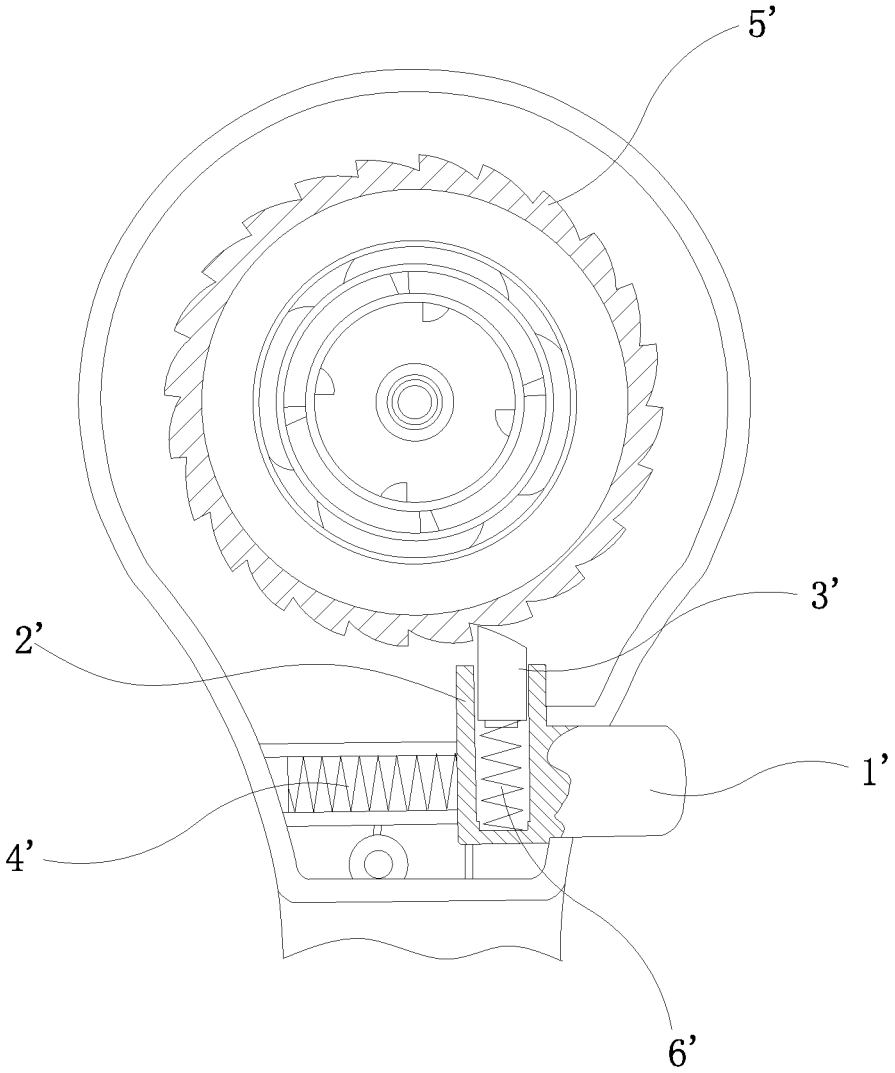
FIG. 12 (PRIOR ART)
FIG. 12 is a cross-sectional view showing the button in a pressed state of a conventional single button switching shower head.

Furthermore, in order to prevent the ratchet wheel 7 from rotating in the reverse direction when the push block 5 is returned, as shown in FIG. 5 to FIG. 7, the bottom of the water distribution disc 8 is provided with a first unidirectional guide rail, and the top of the outlet disc 9 is provided with a second unidirectional guide rail to mesh with the first unidirectional guide rail. Through the cooperation of the first unidirectional guide rail and the second unidirectional guide rail, the water distribution disc 8 can only rotate in one direction, which can prevent the ratchet wheel 7 from rotating in the reverse direction when the push block 5 is returned. Specifically, the first unidirectional guide rail includes a plurality of first oblique teeth 83 disposed on the bottom surface of the water distribution disc 8 and arranged circumferentially. The second unidirectional guide rail includes a plurality of second oblique teeth 92 disposed on the top surface of the outlet disc 9 and arranged circumferentially. The first oblique teeth 83 are unidirectionally meshed with the second oblique teeth 92. The center of the water distribution disc 8 is provided with a rotating shaft 81. The upper portion of the rotating shaft 81 is formed with a flat post 811. The center of the ratchet wheel 7 is provided with a flat hole 71 for insertion the flat post 811. The flat post 811 is clearance fit with the flat hole 71, such that the flat post 811 can move up and down within the flat hole 71 and the water distribution disc 8 can move up and down relative to the water inlet seat 2. The flat hole 71 cooperates with the flat post 811 in a circumferential limit manner so that the ratchet wheel 7 can drive the water distribution disc 8 to rotate synchronously. The upper portion of the flat post 811 may be provided with two claws 812 to hook the edge of the flat hole 71, thereby preventing the flat post 811 from coming off the flat hole 71. An adjusting spring 84 may be disposed between the water distribution disc 8 and the water inlet seat 2 to ensure that the water distribution disc 8 abuts against the outlet disc 9, thereby ensuring the cooperation of the first oblique teeth 83 and the second oblique teeth 92. The adjusting spring 84 is sleeved on the rotating shaft 81. Both ends of the adjusting spring 84 abut against the water distribution disc 8 and the water inlet seat 2, respectively.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A push-button switching shower head structure, comprising a shower head body, a water inlet seat, a button, a push rod, a push block, a return spring, a ratchet wheel, a water distribution disc, and an outlet disc;

the water inlet seat being fixed in the shower head body, the water inlet seat being provided with an upright through hole and an inlet end opening communicating with a water inlet end of the shower head body; a guide groove being defined on a top surface of the water inlet seat, one side of the guide groove, close to the through hole, being provided with a guide surface;

the outlet disc being installed to a water outlet end of the shower head body and located under the water inlet seat, the outlet disc being provided with at least two functional water chambers;

the ratchet wheel being rotatably fitted on the top surface of the water inlet seat and coaxially disposed with the through hole; the water distribution disc being rotatably fitted between the water inlet seat and the outlet disc, the water distribution disc having a rotating shaft that passes through the through hole and is coaxially connected to the ratchet wheel, the water distribution disc being provided with water distribution holes to communicate with water inlets of the functional water chambers;

the push rod being movably fitted on the top surface of the water inlet seat, the push rod being provided with a lateral mounting groove, the return spring being disposed between the push rod and the water inlet seat; the push block being movably inserted into the lateral mounting groove and movably engaged with teeth of the ratchet wheel, the push block being provided with a guide post which is inserted into the guide groove, a side wall of the guide post movably abutting against the guide surface; the button being movably fitted on the shower head body and cooperating with the push rod.

2. The push-button switching shower head structure as claimed in claim 1, wherein the top surface of the water inlet seat is provided with a guide hole, and the push rod is movably inserted into the guide hole.

3. The push-button switching shower head structure as claimed in claim 1, wherein one side of the push rod is provided with a protruding block, the protruding block is formed with a post, the top surface of the water inlet seat is provided with a stopper, the return spring is fitted on the post, and two ends of the return spring hold the protruding block and the stopper, respectively.

4. The push-button switching shower head structure as claimed in claim 1, wherein a bottom of the water distribution disc is provided with a first unidirectional guide rail, and a top of the outlet disc is provided with a second unidirectional guide rail to mesh with the first unidirectional guide rail.

5. The push-button switching shower head structure as claimed in claim 4, wherein the water distribution disc is movable up and down and disposed under the water inlet seat, an adjusting spring is disposed between the water distribution disc and the water inlet seat; the first unidirectional guide rail includes a plurality of first oblique teeth disposed on a bottom surface of the water distribution disc and arranged circumferentially, the second unidirectional guide rail includes a plurality of second oblique teeth disposed on a top surface of the outlet disc and arranged circumferentially, and the first oblique teeth are unidirectionally meshed with the second oblique teeth.

6. The push-button switching shower head structure as claimed in claim 1, wherein the button is hingedly connected to the water inlet seat, the shower head body is provided with an opening for the button to be exposed, a swing block is hingedly connected to the water inlet seat, one end of the swing block abuts against the button, and another end of the swing block abuts against one end of the push rod.

7. The push-button switching shower head structure as claimed in claim 1, wherein a push block spring is provided between the push block and the lateral mounting groove.

8. The push-button switching shower head structure as claimed in claim 1, wherein the water inlet seat is connected with the outlet disc, a water passing chamber is formed between the water inlet seat and the outlet disc, the inlet end opening of the water inlet seat communicates with the water passing chamber, and the water distribution disc is located in the water passing chamber.

9. The push-button switching shower head structure as claimed in claim 1, wherein the guide surface is a curved surface that is coaxially disposed with the through hole.

* * * * *